US005787856A

United States Patent [19]

Dunton

[11] Patent Number: 5,787,856

[45] Date of Patent: Aug. 4, 1998

[54] ROTARY ENGINE

[76] Inventor: Galen M. Dunton, 6200 Emerald Dr., New Port Richey, Fla. 34653

[21] Appl. No.: 858,838

[22] Filed: May 19, 1997

[51] Int. Cl.[6] ..... F02B 53/00

[52] U.S. Cl. ..... 123/244

[58] Field of Search ..... 123/228, 244

[56] References Cited

U.S. PATENT DOCUMENTS

| | | | |
|---|---|---|---|
| 1,674,449 | 6/1928 | Riggs | 123/244 |
| 3,155,081 | 11/1964 | Gonzalez | 123/244 |
| 4,178,900 | 12/1979 | Larson | 123/244 |
| 4,446,829 | 5/1984 | Yeager | 123/244 |

*Primary Examiner*—Tony M. Argenbright
*Attorney, Agent, or Firm*—Stanley M. Miller

[57] ABSTRACT

A rotary engine has a rotor shaft, a power rotor carried by and rotating conjointly with the rotor shaft, a pair of stators disposed radially outwardly of the power rotor, an annular cam ring, disposed radially outwardly of the stators, connected to and rotating conjointly with the rotor shaft, and at least one cavity formed in the power rotor that enters into fluid communication, sequentially, with an intake port, a combustion port, and an exhaust port as the engine rotates. Oscillating members that are pivotally mounted to an engine housing close the ports under the influence of cam lobes formed on the cam ring and the ports are opened by the shape of the cavity or cavities driving the oscillating members radially outwardly as the engine rotates.

12 Claims, 7 Drawing Sheets

0° TDC
180° BDC
0°
18°
168°
198°
348°
10
12
17
18
27
28
30
32
34
36
38
40
42
50
52
60
62
70
72
74
80

0° TDC

18°

168°

180° BDC

198°

348°

ROTARY ENGINE

BACKGROUND OF THE INVENTION

1. Field of the Invention

This invention relates, generally, to internal combustion rotary engines. More particularly, it relates to a rotary engine having one or more power cavities that sequentially align with an intake port, a combustion port, and an exhaust port as the engine rotates.

2. Description of the Prior Art

Rotary engines eliminate the reciprocal motion of conventional pistons and for that reason operate more smoothly and efficiently than conventional engines. The famous Wankel engine was never fully developed, however, due to problems with engine seals and other problems relating to engine complexity. What is needed, then, is a structurally simple rotary engine that is free of sealing problems.

However, in view of the art considered as a whole at the time the present invention was made, it was not obvious to those of ordinary skill in the art how such a rotary engine could be provided.

SUMMARY OF THE INVENTION

The longstanding but heretofore unfulfilled need for an apparatus that overcomes the limitations of the prior art is now met by a new, useful, and nonobvious invention. The inventive rotary engine includes an engine housing, a rotor shaft rotatably mounted in the engine housing in coincidence with a longitudinal axis of symmetry of the engine housing, a power rotor carried by and rotating conjointly with the rotor shaft, a pair of stators disposed radially outwardly of the power rotor, an annular cam ring, disposed radially outwardly of the stators, connected to and rotating conjointly with the rotor shaft, a radially inwardly extending cam lobe formed on the cam ring, an intake port formed in the engine housing, a combustion port formed in the engine housing, an exhaust port formed in the engine housing, at least one cavity of predetermined shape formed in the power rotor that enters into fluid communication, sequentially, with the intake, combustion, and exhaust ports as the engine rotates, and a plurality of oscillating members that are pivotally mounted to the engine housing. Each oscillating member has a radially outwardly extending cam follower, so that the ports are sequentially closed by the oscillating members under the influence of the cam lobe and so that the ports are sequentially opened by the predetermined shape of the at least one cavity which drives the oscillating members radially outwardly as the engine rotates.

It is a primary object of this invention to provide a rotary engine with very few moving parts.

Another object is to provide a rotary engine having no compartment-sealing problems.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
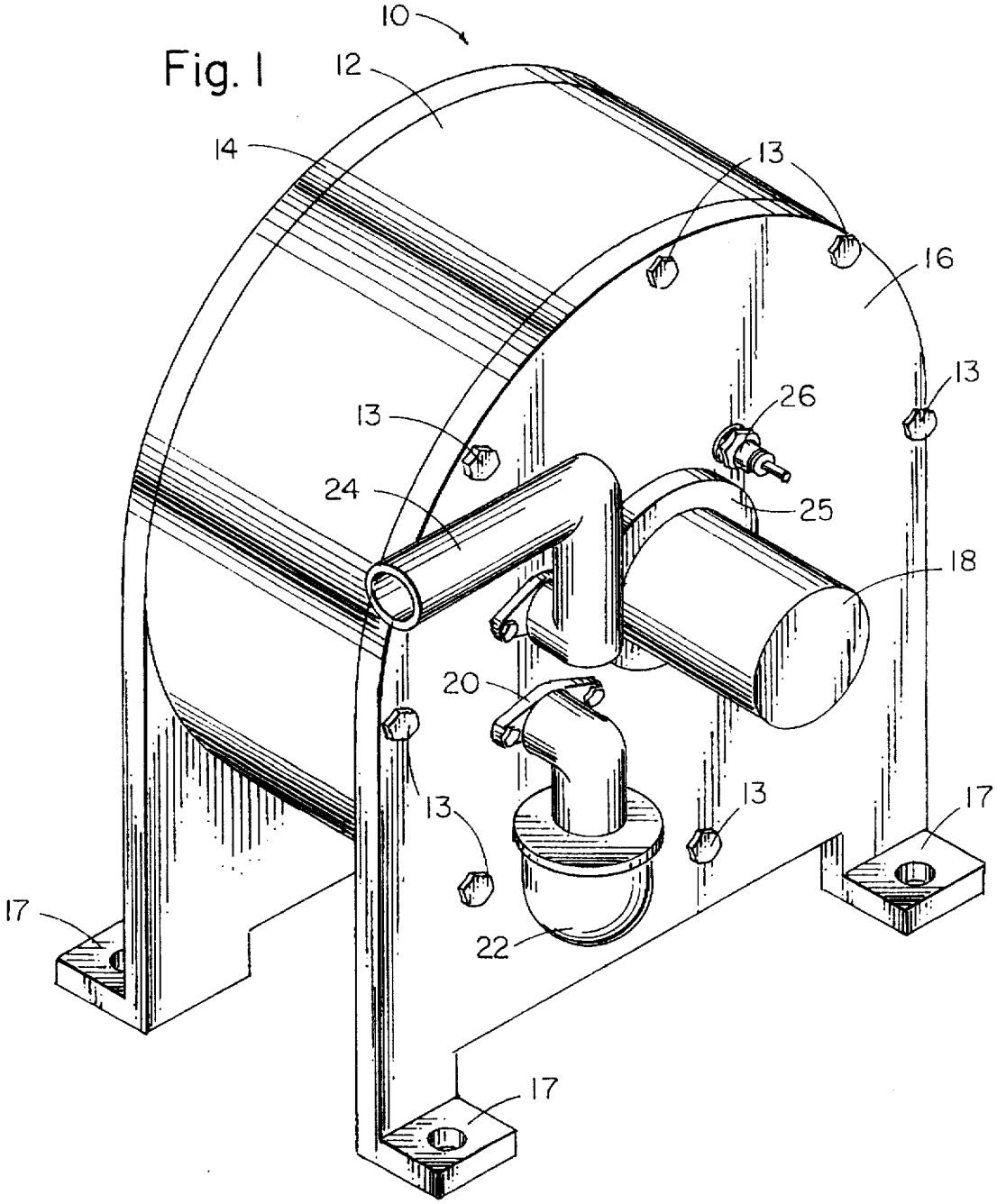
FIG. 1 is a perspective view of an illustrative embodiment of the novel engine.
Figure 2:
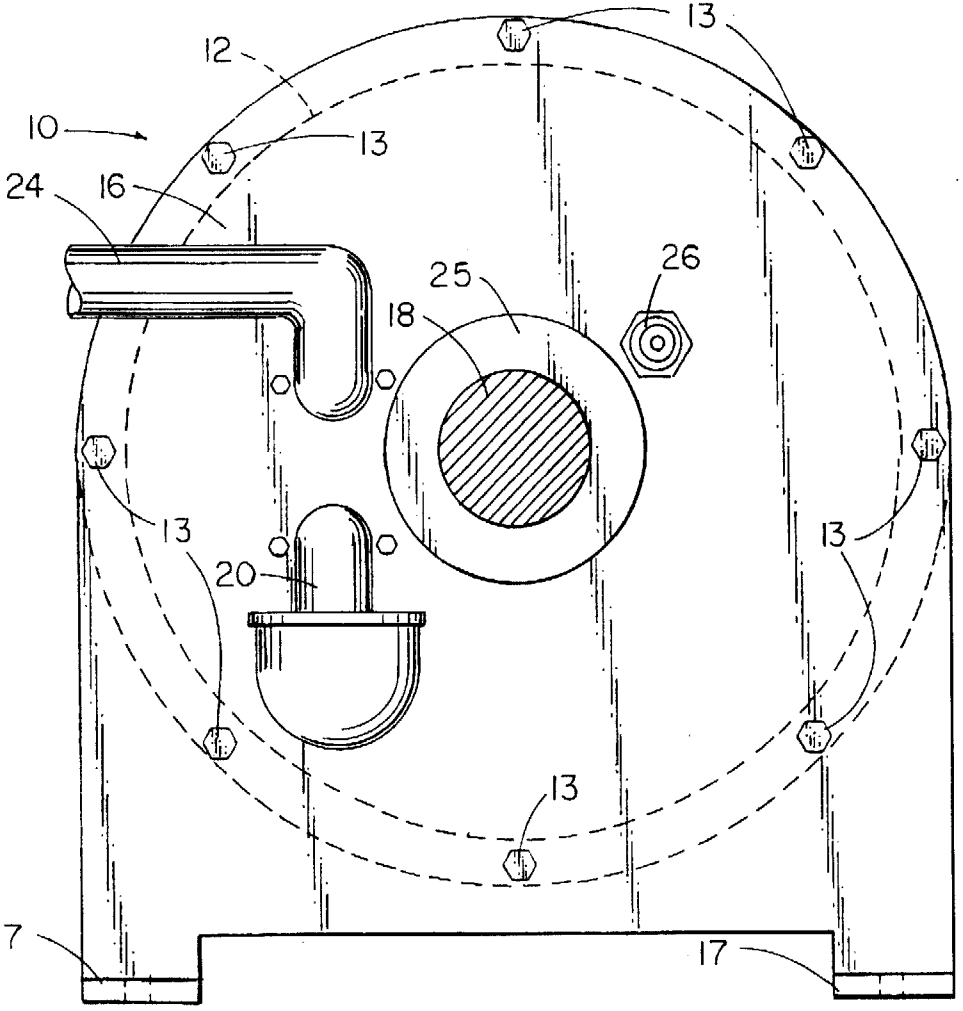
FIG. 2 is a front elevational view thereof.
Figure 3:
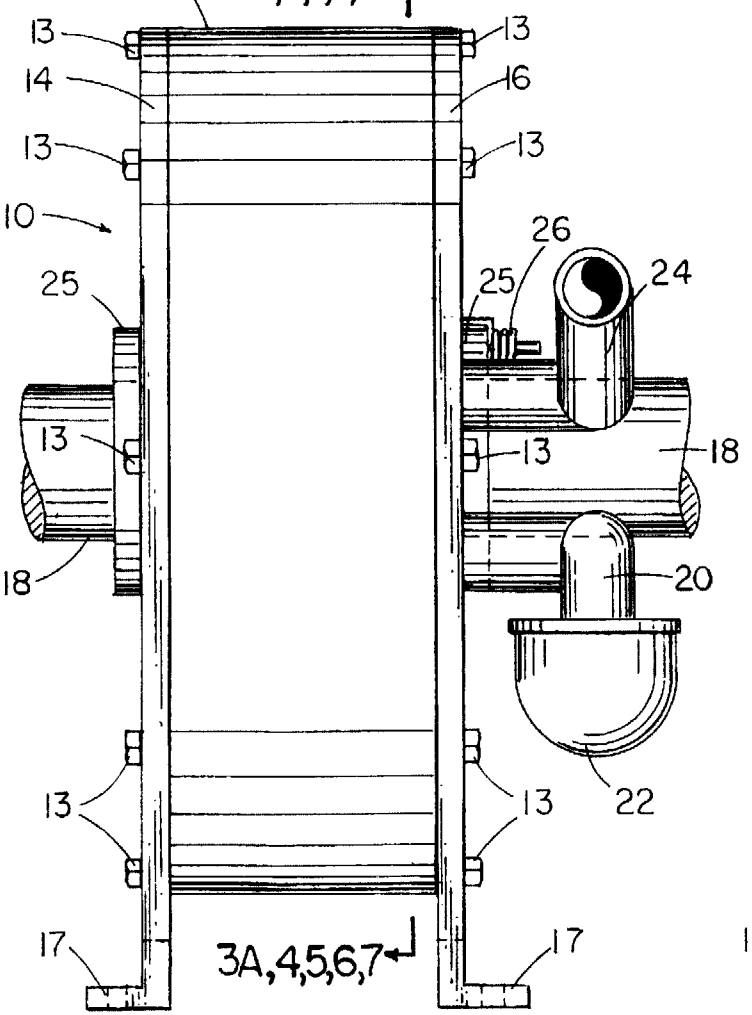
FIG. 3 is a side elevational view thereof.

Referring now to FIGS. 1–3, it will there be seen that an exemplary embodiment of the invention is denoted as a whole by the reference numeral 10.

Figure 3A:
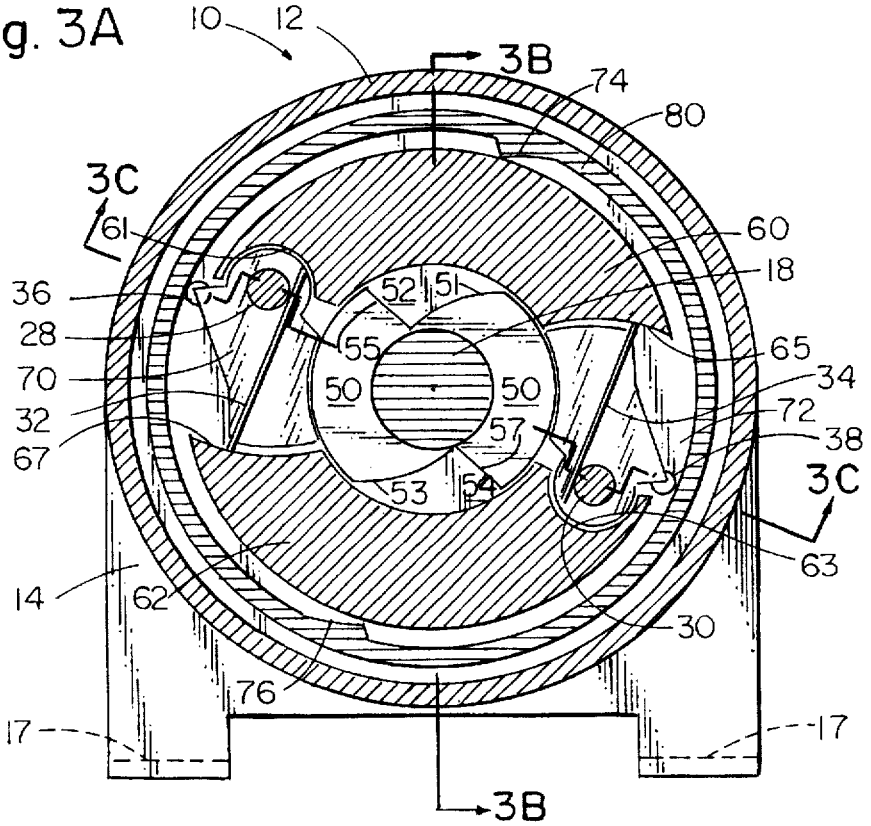
FIG. 3A is a sectional view taken along line 3A—3A in FIG. 3.
Figure 3B:
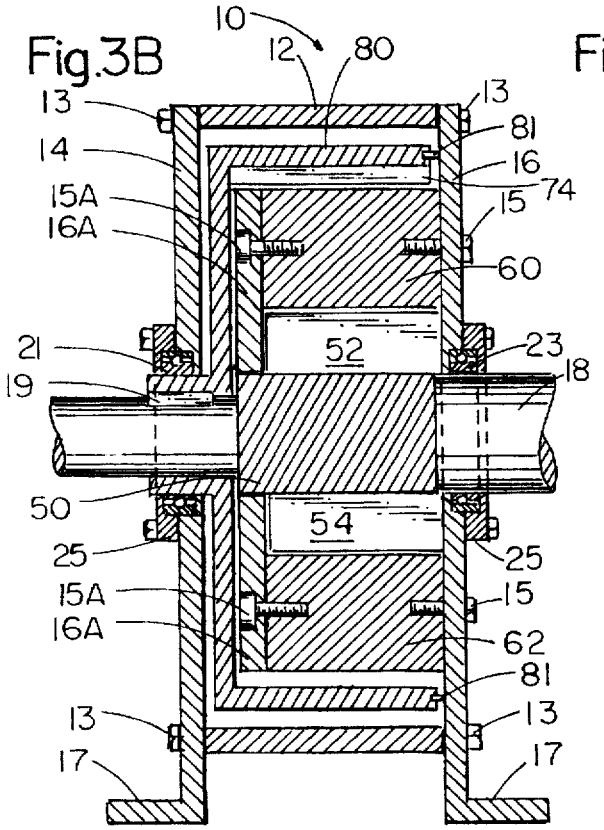
FIG. 3B is a sectional view taken along line 3B—3B in FIG. 3A.

Rotary engine 10 includes a cylindrical body 12, a flat, imperforate rear closure plate 14, a flat, front closure plate 16 that is not imperforate, and an intermediate plate 16A (FIGS. 3A and 3B). A plurality of circumferentially spaced bolts, collectively denoted 13, secure front and rear closure plates 14 and 16 to cylindrical body 12.

Motor mounts or lugs, collectively denoted 17, are formed by bending each closure plate at its opposite lowermost corners as depicted; each motor mount is centrally apertured to receive a mounting screw or other fastening means that secures engine 10 to a support surface, not shown. The support surface could form a part of the body of an automobile, truck, boat, or other vehicle.

Closure plates 14 and 16 and intermediate plate 16A are centrally apertured to receive rotor shaft 18. Shaft bearings 21 and 23 (FIGS. 3A–3C) enable low friction rotation of rotor shaft 18 with respect to the nonrotating cylindrical body 12 and said closure plates 14 and 16. An annular bearing retainer cap 25 performs the function its name expresses.

Intake throat 20 is mounted on front closure plate 16 in registration and fluid communication with an opening 42 formed in said plate (see FIGS. 4A–F) which serves as the intake port of the engine. Reference numeral 22 represents a fuel/air mixture delivery device such as a carburetor or a fuel injector. Exhaust pipe 24 is in registration and fluid communication with an opening 40 formed in closure plate 16, said opening 40 serving as the exhaust port for the novel engine, as best understood in connection with FIGS. 4A–F.

Spark plug 26 is mounted in another opening formed in front closure plate 16; said opening is denoted 27 in FIGS. 4A–4F; it serves as the combustion port of the engine. Like exhaust port 40 and intake port 42, combustion port 27 does not rotate.

Turning now to FIG. 3A, there it will be seen that a power rotor 50 is positioned radially outwardly of rotor shaft 18, in contacting relation thereto. Power rotor may be keyed to rotor shaft 18 for conjoint rotation, or it may be integrally formed with rotor shaft 18. A first power cavity 52 and a second power cavity 54 are formed in said power rotor 50, in mirror image opposed relation to one another. Note that each power cavity 52, 54 has a convex surface 51, 53, respectively, that extends circumferentially from a radially outermost surface of the power rotor 50 to the radially outermost surface of the rotor shaft 18, and a radially extending straight surface 55, 57, respectively, that extends radially from said power rotor surface toward said rotor shaft surface. Straight surfaces 55, 57 represent the respective leading ends of cavities 52, 54. These straight and convex surfaces define cavities into which fuel/air mixtures are received, into which expanding combustion gases are received, and from which exhaust gases are expelled into an external environment as the engine operates.

A first, arcuate-in-configuration stator 60 is positioned radially outwardly from first power cavity 52 and seals it shut when the engine is in the position of FIG. 3A, said first stator 60 having an arcuate radially innermost surface that conforms to the radially outermost curvature of power rotor 50 as depicted. A second stator 62 of similar structure is positioned in opposed relation to first stator 60 and serves to close power cavity 54 when the engine is in its FIG. 3A position. Bolts 15 (FIG. 3B) secure the stators to front closure plate 16.

Note that a semicircular concavity 61 is formed in a trailing end of first stator 60 and that a semicircular concavity 63 is formed in a trailing end of second stator 62. Note further that a shallow concavity 65 is formed in a leading end of first stator 60 and that a shallow concavity 67 is formed in a leading end of second stator 62.

Figure 3C:
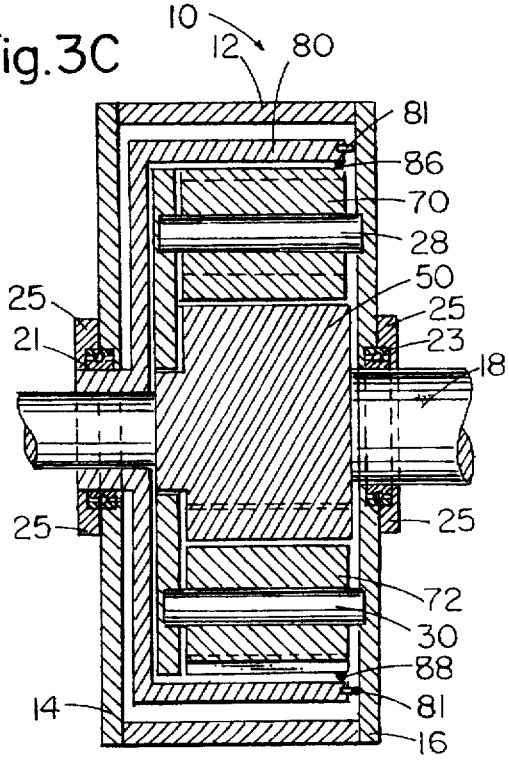
FIG. 3C is a sectional view taken along line 3C—3C in FIG. 3A.

These concavities are provided to accommodate first and second oscillating members 70 and 72 which are mounted on pivot pins 28 and 30, respectively. The opposite ends of pivot pins 28 and 30 are secured in front closure plate 16 and intermediate plate 16A, respectively, as indicated in FIG. 3C. Allen screws 15A, or other suitable fastening means, secure intermediate plate 16A to stators 60, 62, and said intermediate plate encloses the cavity within which oscillating members 70, 72 are contained. Note that rear closure plate 14, front closure plate 16, and intermediate plate 16A are stationary, i.e., nonrotatable members.

Linear seals 32, 34 are positioned between the respective radially inner and outer parts of oscillating members 70, 72; moreover, said linear seals surround their respective oscillating members.

A cam follower 36, 38 is formed in the radial outer side of each oscillating member 70, 72, respectively. Accordingly, displacement of said cam followers 36, 38 will effect pivotal movement of said oscillating members 70, 72, respectively.

Said displacement is effected by a pair of diametrically opposed, radially inwardly extending cam lobes 74, 76 formed in cam ring 80 which is positioned in concentric relation to cylindrical engine housing 12 between said housing and said stators 60, 62. A key 19 (FIG. 3B) is disposed in a keyway formed in power rotor 50 and cam ring 80 and keys said cam ring to said power rotor for conjoint rotation therewith. Power rotor 50 and cam ring 80 could also be formed integrally with one another. Note cam ring seal 81 (FIGS. 3B and 3C), carried by the cam ring, that seals the annular space between the forward edge of said cam ring and the rear surface of front closure plate 16.

Thus, rotation of power rotor 50 and cam ring 80 causes cam lobes 74, 76 to alternately bear against and displace cam followers 36, 38 so that oscillating members 70, 72 are pivoted radially inwardly with respect to their FIG. 3A positions. As will become more clear as this description proceeds, the convex surfaces 51 and 53 of power cavities 52 and 54, respectively, cause said oscillating members to pivot radially outwardly from said radially inward positions as said power rotor 50 rotates.

Figures 4A, 4B, 4C, 4D, 4E, 4F:
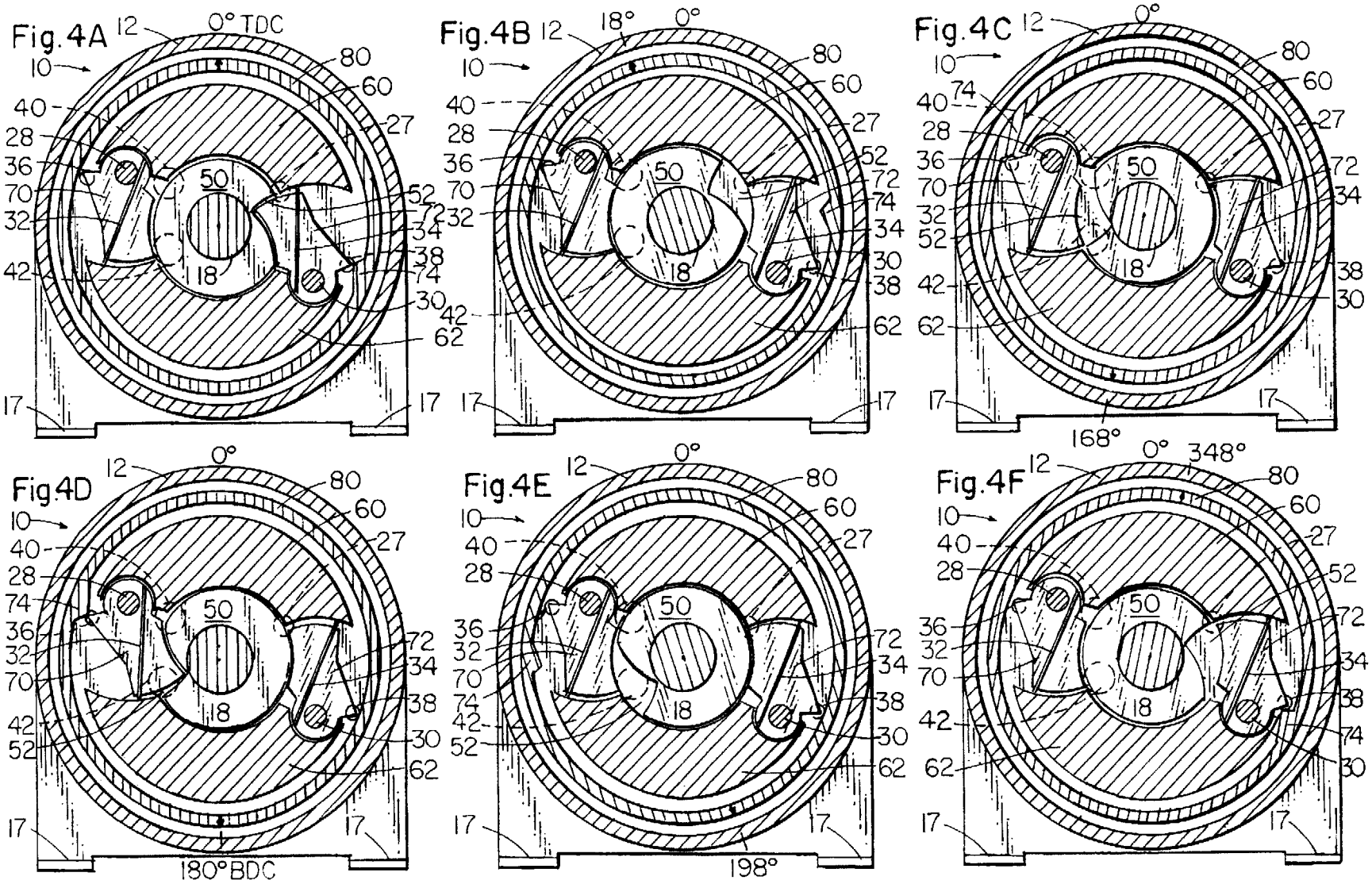
FIG. 4A is a sectional view taken along line 4—4 in FIG. 3, depicting the top dead center position of a first embodiment of the engine.
FIG. 4B is a sectional view taken along line 4—4 in FIG. 3, depicting the engine rotated counterclockwise eighteen degrees from the top dead center position of FIG. 4A.
FIG. 4C is a sectional view taken along line 4—4 in FIG. 3, depicting the engine rotated counterclockwise one hundred sixty eight degrees from the top dead center position of FIG. 4A.
FIG. 4D is a sectional view taken along line 4—4 in FIG. 3, depicting the bottom dead center position of the engine.
FIG. 4E is a sectional view taken along line 4—4 in FIG. 3, depicting the engine rotated eighteen degrees counterclockwise from the bottom dead center position of FIG. 4D.
FIG. 4F is a sectional view taken along line 4—4 in FIG. 3, depicting the engine rotated counterclockwise one hundred sixty eight degrees from the bottom dead center position of FIG. 4D.

In a first embodiment of the invention, only one power cavity 52 is formed in power rotor 50. FIGS. 4A–F depict six positions of said one power cavity embodiment. In FIG. 4A, the engine is in its top dead center (TDC) position. Note spark plug orifice or combustion port 27 and the radially inwardly pivoted position of oscillating member 72. When so pivoted, said member 72 occupies substantially all of power cavity 52, leaving only a small gap at the leading end thereof into which expanding combustion gases may enter when spark plug 26 is fired. Note further that when the plug fires, oscillating member 72 is not blown back into its outwardly pivoted position because cam lobe 74 is holding it in its radially inwardly pivoted position. Thus, the force of the expanding gases urges rotation of power rotor 50 in a counterclockwise direction. As power rotor 50 rotates under the influence of the expanding gases, cam lobe 74 rotates in the same direction conjointly therewith and arcuate surface 53 of power cavity 52 causes oscillating member 72 to pivot radially outwardly, all as best understood by comparing FIG. 4B with FIG. 4A. FIG. 4B depicts the engine after it has rotated about eighteen degrees in a counterclockwise position from its FIG. 4A position. Note further that the position of oscillating member 70 is unaffected by the rotation of power rotor 50 since there is no second power cavity in this embodiment.

FIG. 4C depicts the engine when it has rotated about one hundred sixty eight degrees in a counterclockwise direction relative to its FIG. 4A position. Power cavity 52 is now in fluid communication with exhaust port 40 and intake port 42; oscillating member 72 has not yet pivoted radially inwardly because leading surface 57 of power cavity 54 has just rotated into the depicted position and cam lobe 74 is just beginning to contact cam follower 36.

FIG. 4D, which represents the bottom dead center (BDC) position of the novel engine, indicates the engine after a further eighteen degree rotation from the position of FIG. 4C. Oscillating member 70 has been urged by cam lobe 74 into its radially inwardly pivoted position, and such inward pivoting has driven exhaust gases out of power cavity 52. At this moment, fuel intake begins; note that the leading end of power cavity 52, i.e., the only part of said power cavity not occupied by said oscillating member 70, is in registration with intake port 42.

An additional eighteen degree rotation is depicted in FIG. 4E; note that intake port 42 is now in fully open fluid communication with power cavity 52. Note further that as oscillating member 52 is displaced from its FIG. 4D position to its FIG. 4E position by convex bottom wall 51 of power cavity 52 bearing against it, a suction is created which draws a fuel/air mixture into power cavity 52.

FIG. 4F depicts the engine after another one hundred sixty eight degree rotation, relative to the position of FIG. 4E. Leading surface 55 of power cavity 52 has just cleared the free end of oscillating member 72 and cam lobe 74 is about to cause oscillating member 72 to pivot radially inwardly into power cavity 52, and FIG. 4A depicts the engine after said radially inwardly pivoting has taken place and the engine has returned to its TDC position. Such radially inward pivoting compresses the intake fuel/air mixture, and the firing of spark plug 26 when the engine returns to its TDC position causes continued repeated rotation of power rotor 50 and rotor shaft 18.

Figures 5A, 5B, 5C, 5D, 5E, 5F:
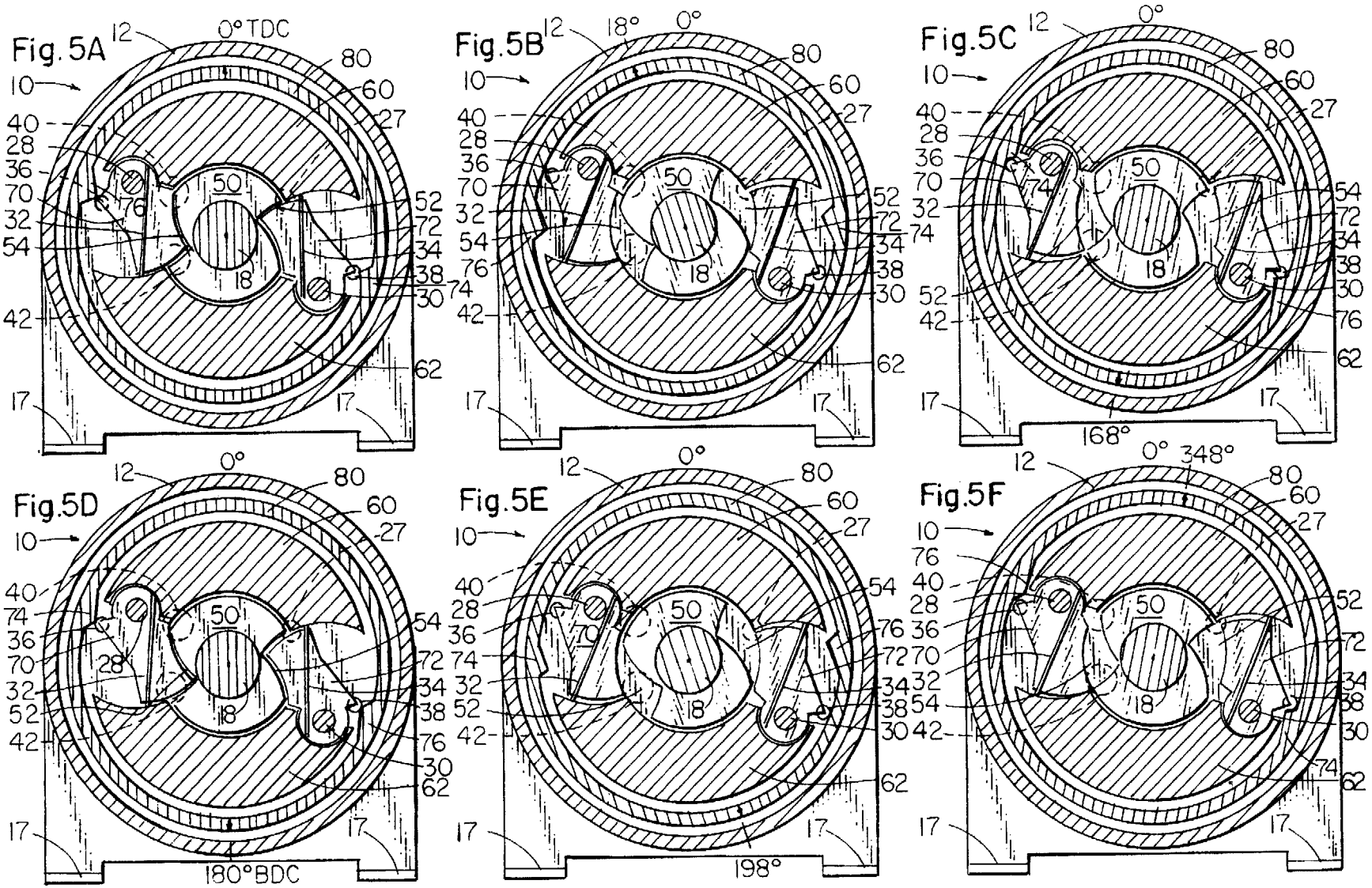
FIG. 5A is a sectional view taken along line 5—5 in FIG. 3, depicting the top dead center position of a second embodiment of the engine.
FIG. 5B is a sectional view taken along line 5—5 in FIG. 3, depicting the engine rotated counterclockwise eighteen degrees from the top dead center position of FIG. 5A.
FIG. 5C is a sectional view taken along line 5—5 in FIG. 3, depicting the engine rotated counterclockwise one hundred sixty eight degrees from the top dead center position of FIG. 5A.
FIG. 5D is a sectional view taken along line 5—5 in FIG. 3, depicting the bottom dead center position of the second embodiment of the engine.
FIG. 5E is a sectional view taken along line 5—5 in FIG. 3, depicting the engine rotated eighteen degrees counterclockwise from the bottom dead center position of FIG. 5D.
FIG. 5F is a sectional view taken along line 5—5 in FIG. 3, depicting the engine rotated counterclockwise one hundred sixty eight degrees from the bottom dead center position of FIG. 5D.

A second power cavity 54 is added to the embodiment of FIGS. 5A–F. This embodiment of the engine operates in substantially the same way as the embodiment of FIGS. 4A–F, but with additional cycles being performed simultaneously with the cycles already described. More particularly, At TDC (FIG. 5A), when power cavity 52 is beginning its power cycle, i.e., as spark plug 26 is beginning to fire, power cavity 54 is completing its exhaust cycle. After an eighteen degree counterclockwise rotation, as depicted in FIG. 5B, power cavity 52 is in its power cycle and vaporized gas is being sucked into power cavity 54 as a part of its intake cycle. At about one hundred sixty eight degrees of counterclockwise rotation relative to the TDC position, as depicted in FIG. 5C, power cavity 52 is beginning its exhaust cycle and power cavity 54 is beginning its compression cycle. As indicated in FIG. 5D, at about one hundred eighty degrees of counterclockwise rotation relative to TDC, i.e., at BDC, power cavity 52 begins its intake cycle and power cavity 54 is in its power or firing cycle. About eighteen degrees after BDC, as seen in FIG. 5E, power cavity 52 is completing its intake cycle and power cavity 54 is in its power cycle. About one hundred sixty eight degrees of counterclockwise rotation thereafter, as seen in FIG. 5F, power cavity 52 is beginning its compression cycle and power cavity 54 is beginning its exhaust cycle.

Thus, both power cavities 52 and 54 are fired one time for each three hundred sixty degree revolution of the engine, i.e., there are two power cycles for each engine revolution. Thus, the embodiment of FIGS. 5A–F will operate at about twice the efficiency of the embodiment of FIGS. 4A–F, even though the only added parts are an additional power cavity and an additional cam lobe.

Figure 6:
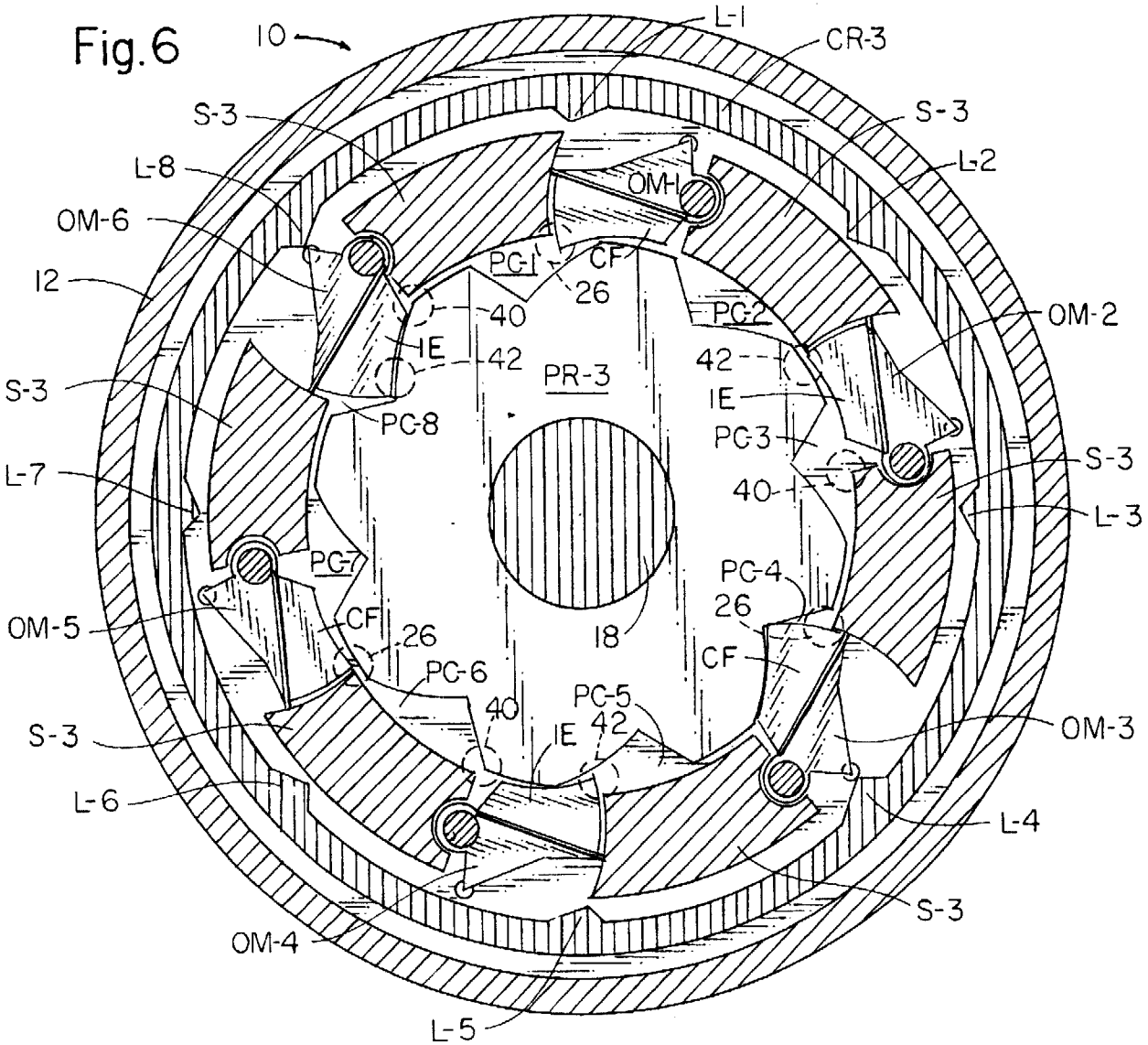
FIG. 6 is a sectional view taken along line 6—6 in FIG. 3.

FIG. 6 depicts an embodiment having eight power cavities, denoted PC-1, PC-2, PC-3, PC-4, PC-5, PC-6, PC-7, and PC-8, formed in equidistantly and circumferentially spaced relation to one another about the circumference of members, denoted OM-1, OM-2, OM-3, OM-4, OM-5, and OM-6. The odd-numbered oscillating members are further denoted as CF, indicating that they are compression/firing members, and the even-numbered oscillating members are further denoted IE, circumferentially and equidistantly spaced stators are collectively denoted S-3.

An intake port 42 is positioned at the free end of each intake/exhaust oscillating member and an exhaust port 40 is positioned at the pivotally attached end of each intake/exhaust oscillating member, said intake and exhaust ports being in fluid communication with respective intake and exhaust manifolds. A spark plug 26 is positioned at the free end of each compression/firing oscillating member in communication with combustion port 27. Cam ring 80 in this embodiment has eight equidistantly and circumferentially spaced lobes, denoted L-1, L-2, L-3, L-4, L-5, L-6, L-7, and L-8. Operation of this engine is in accordance with the principles of the engines of FIGS. 4A–F and 5A–F.

Figure 7B:
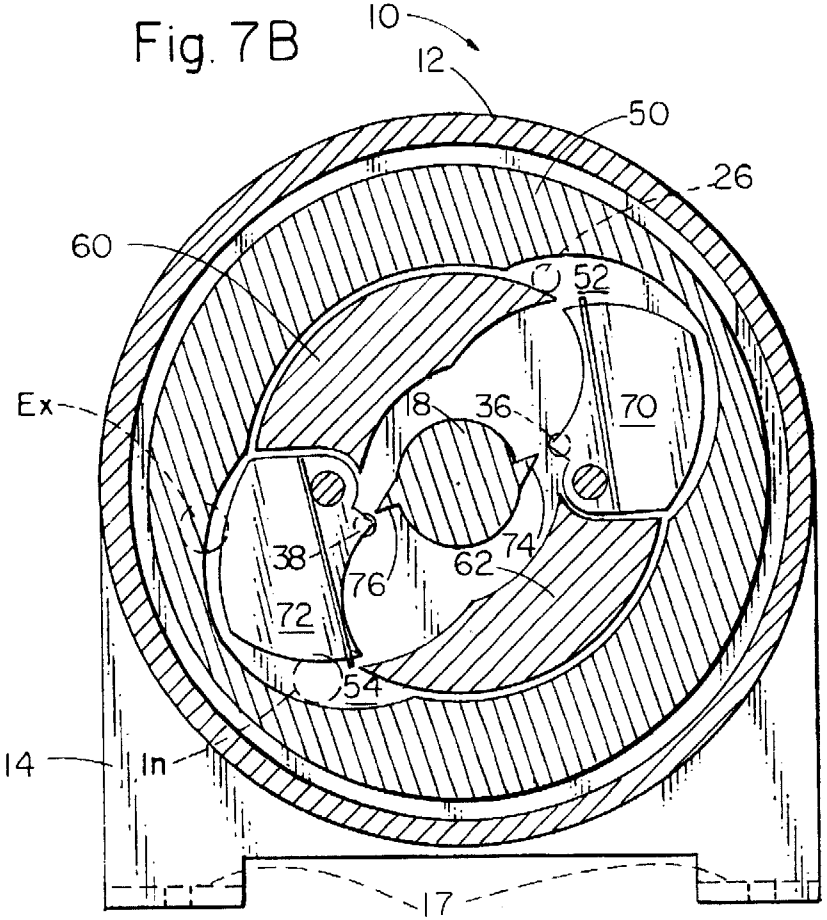
FIG. 7B is a sectional view taken along line 7—7 in FIG. 3, depicting the position of engine of FIG. 7A rotated counterclockwise eighteen degrees from its FIG. 7A position.
Figure 7A:
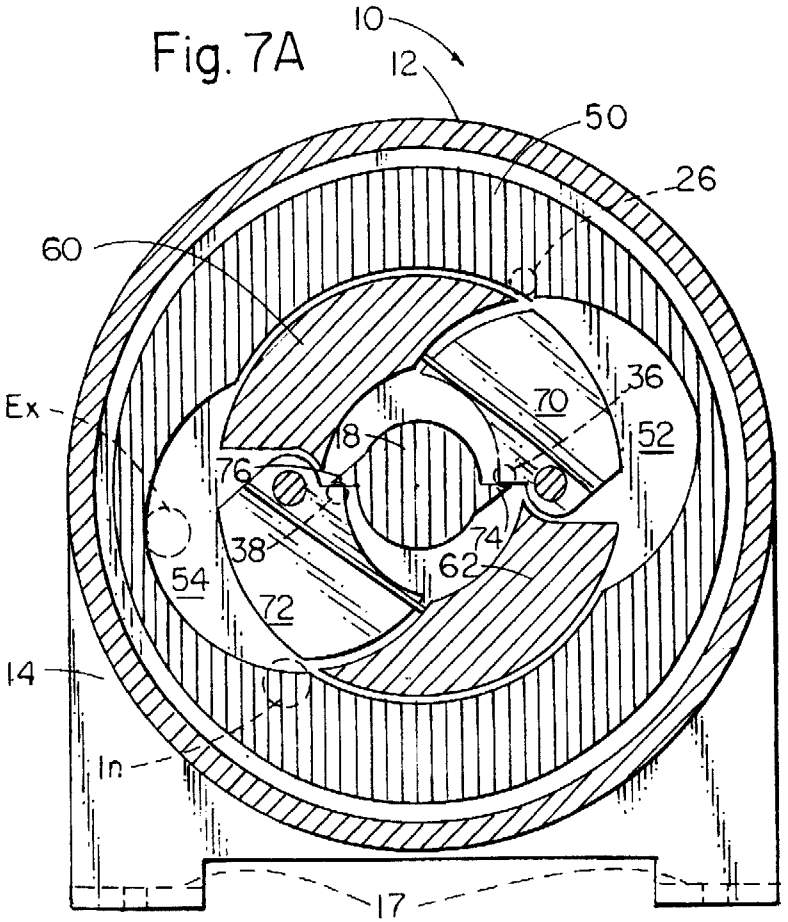
FIG. 7A is a sectional view taken along line 7—7 in FIG. 3, depicting a third embodiment of the novel engine.

FIGS. 7A and 7B illustrate still another variation of the novel engine. Although it operates with the same general principles of operation, it is essentially an inside-out version of the above-disclosed inventions. More particularly, power rotor 50 has an annular configuration in this embodiment and is positioned where cam ring 80 is positioned in the first-described embodiments. Power cavities 52, 54 are formed in a radially innermost surface of power rotor 50, and oscillating members 70, 72 are pivotally mounted so that their respective free ends swing alternately radially outwardly into and radially outwardly out of said power cavities as said power rotor rotates under the force of expanding combustion gases. Each oscillating member has a cam follower 36, 38 as in the first-described embodiments, but the cam lobes 74, 76 that successively abut said cam followers to displace the oscillating members are formed on the outer periphery of the centrally disposed rotor shaft 18.

Such inside-out version of the novel engine is depicted in its TDC position in FIG. 7A. Power cavity 52 is just beginning its compression cycle and power cavity 54 is just beginning its exhaust cycle. After an eighteen degree counterclockwise rotation, as depicted in FIG. 7B, power cavity 52 is beginning its power stroke and power cavity 54 is beginning its intake stroke.

The novel engine is lubricated by delivering pressurized lubricant to the central bearings and by employing a splash system including splash vanes positioned about the periphery of the cam ring in the first-described embodiments and about the periphery of the power rotor in the last-described embodiment.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A rotary engine, comprising:

an engine housing;

a rotor shaft rotatably mounted in said engine housing in coincidence with a longitudinal axis of symmetry of said engine housing;

a power rotor carried by and rotating conjointly with the rotor shaft;

a pair of stators disposed radially outwardly of the power rotor;

an annular cam ring, disposed radially outwardly of the stators, connected to and rotating conjointly with the rotor shaft;

a radially inwardly extending cam lobe formed on said cam ring;

an intake port formed in said engine housing;

a combustion port formed in said engine housing;

an exhaust port formed in said engine housing;

at least one cavity of predetermined shape formed in the power rotor that enters into fluid communication, sequentially, with said intake port, said combustion port, and said exhaust port as said engine rotates; and a plurality of oscillating members that are pivotally mounted to said engine housing;

each oscillating member of said plurality of oscillating members having a radially outwardly extending cam follower;

whereby said ports are sequentially closed by said oscillating members under the influence of said cam lobes; and whereby said ports are sequentially opened by said predetermined shape of said at least one cavity which drives the oscillating members radially outwardly as the engine rotates.

2. The rotary engine of claim 1, wherein said predetermined shape of said at least one cavity is defined by a leading wall of said cavity that extends radially inwardly from a surface of said power rotor toward a surface of said rotor shaft and by a convex bottom wall of said cavity that extends from a radially innermost end of said leading wall to a surface of said power rotor.

3. The rotary engine of claim 1, wherein said engine housing is cylindrical and has opposite ends closed by a rear closure plate and a front closure plate.

4. The rotary engine of claim 1, wherein said intake port is in fluid communication with a source of a fuel and air mixture.

5. The rotary engine of claim 1, wherein said combustion port is in fluid communication with a means for igniting a fuel and air mixture.

6. The rotary engine of claim 1, wherein said exhaust port is in fluid communication with an environment external to said engine housing.

7. The rotary engine of claim 3, further comprising an intermediate plate positioned between said front and rear closure plates, each stator of said pair of stators being secured to said front closure plate and to said intermediate plate, and said oscillating members being mounted on pivot pins the opposite ends of which are secured to said front closure plate and to said intermediate plate.

8. A rotary engine, comprising:

a cylindrical housing;

a front cover plate closing a first end of said cylindrical housing;

a rear cover plate closing a second end of said cylindrical housing;

a rotatably mounted rotor shaft positioned coincident with a longitudinal axis of symmetry of said cylindrical housing;

a power rotor disposed in overlying relation to said rotor shaft and mounted for conjoint rotation therewith;

at least one cavity of predetermined shape formed in said power rotor;

a pair of diametrically opposed, arcuate in configuration stators positioned radially outwardly of said power rotor;

an annular cam ring positioned radially outwardly of said stators, said annular cam ring being secured to said rotor shaft for conjoint rotation therewith;

said annular cam ring having a radially inwardly disposed cam lobe formed therein;

said power rotor, said stators and said cam ring being concentrically disposed with respect to said longitudinal axis of symmetry;

an intake port formed in said front closure plate so that said intake port is in transient communication with said at least one cavity one time per revolution as said rotor shaft rotates;

a combustion port formed in said front closure plate so that said combustion port is in transient communication with said at least one cavity one time per revolution as said rotor shaft rotates;

an exhaust port formed in said front closure plate so that said exhaust port is in transient communication with said at least one cavity one time per revolution as said rotor shaft rotates;

a pair of diametrically opposed oscillating members;

each of said oscillating members having a first end pivotally secured to said front and rear cover plates;

a cam follower formed on a radially outward surface of each of said oscillating members;

said cam lobe successively bearing against said respective cam followers and effecting radially inward pivoting of said respective oscillating members into said at least one cavity as said rotor shaft and hence said cam ring rotate as said engine operates;

a radially inward surface of each of said oscillating members having an arcuate surface adapted to slidingly engage said power rotor as said power rotor rotates;

said at least one cavity having a leading wall that extends radially toward said rotor shaft;

said at least one cavity having a convex bottom surface that successively drives said oscillating members out of said at least one cavity as said rotor shaft rotates;

whereby said intake, combustion and exhaust ports are sequentially closed and opened by said oscillating members entering thereinto and exiting therefrom, respectively, as said engine operates.

9. A rotary engine, comprising:

a cylindrical engine housing;

a rotor shaft disposed in coincidence with a longitudinal axis of symmetry of said engine housing;

a pair of radially outwardly extending cam lobes formed on said rotor shaft;

an annular power rotor positioned in concentric relation to said rotor shaft in radially spaced apart relation thereto;

a pair of opposed power cavities formed in said power rotor, each of said power cavities having a bottom wall of predetermined shape;

a pair of opposed oscillating members pivotally mounted to said engine housing, radially outwardly of said rotor shaft and radially inwardly of said power rotor;

a pair of stators secured to said engine housing, said stators being positioned radially outwardly of said rotor shaft and radially inwardly of said power rotor, in equicentric relation to said oscillating members;

an intake port, a combustion port, and an exhaust port formed in said engine housing, said ports being in sequential, transient fluid communication with said power cavities as said engine rotates;

said oscillating members sequentially closing said ports as said oscillating members are pivoted radially outwardly by said cam lobes; and said oscillating members sequentially opening said ports as said oscillating members are driven out of said power cavities by the respective predetermined shapes of said bottom walls of said power cavities.

10. The rotary engine of claim 9, further comprising a rear closure plate and a front closure plate for closing opposite ends of said engine housing.

11. The rotary engine of claim 10, further comprising an intermediate plate positioned between said front and rear closure plates and wherein said oscillating members are pivotally secured at respective first ends thereof to said front closure plate and said intermediate plate.

12. The rotary engine of claim 10, wherein said intake, combustion, and exhaust ports are collectively formed in said front closure plate in circumferentially spaced relation to one another.

* * * * *